US006488510B2

(12) United States Patent
Li

(10) Patent No.: US 6,488,510 B2
(45) Date of Patent: Dec. 3, 2002

(54) ROTARY-PLUG WALL LAMP

(75) Inventor: Ron Chung Li, Hsin-Chu (TW)

(73) Assignee: Long-Beam Enterprise Co., Ltd., Hsin-Chu (TW)

( * ) Notice: Subject to any disclaimer, the term of this patent is extended or adjusted under 35 U.S.C. 154(b) by 0 days.

(21) Appl. No.: 09/813,311

(22) Filed: Mar. 21, 2001

(65) Prior Publication Data

US 2002/0137394 A1 Sep. 26, 2002

(51) Int. Cl.[7] ..... H01R 39/00

(52) U.S. Cl. ..... 439/13; 439/27; 362/226

(58) Field of Search ..... 439/647, 11, 13, 439/20–22, 31, 640, 655, 27; 362/226, 287

(56) References Cited

U.S. PATENT DOCUMENTS

| | | | | | |
|---|---|---|---|---|---|
| 5,352,122 | A | * | 10/1994 | Speyer et al. | 439/13 |
| 5,683,254 | A | | 11/1997 | Lin | 439/11 |
| 5,954,519 | A | * | 9/1999 | Hsiao | 439/21 |
| 6,093,028 | A | * | 7/2000 | Yang | 439/11 |

* cited by examiner

*Primary Examiner*—Hien Vu
(74) *Attorney, Agent, or Firm*—Troxell Law Office PLLC

(57) ABSTRACT

A rotary-plug wall lamp, which comprises a socket body having a seat hole to be mounted with a ring-shaped copper piece and a contact copper piece riveted in place; the outer ends of the two contact copper pieces are in contact with the power copper pins of the rotary disk respectively; the inner edge thereof is in contact with the contact points of the circuit board; the rotary disk and the socket body are connected electrically through a shaft contact point therein and a ring-shaped contact point so as to supply power for the wall lamp, which can be turned freely within an angle of 270 degrees.

1 Claim, 6 Drawing Sheets

ROTARY-PLUG WALL LAMP

BACKGROUND OF THE INVENTION

1. Field of the Invention

This invention relates to a wall lamp, and particularly to a rotary-plug wall lamp.

2. Description of the Prior Art

In the conventional wall lamp, the two copper plugs and the socket body are made into one piece; such copper plugs are usually limited with the installation direction of the power outlet, i.e., an ornament on the upper end or outer end of the socket body is unable to set upwards as it should.

There is a conventional plug structure, which was used in a liquid type of mosquito smudge heated with an electric heater. The heater is mounted in an upper body portion and a lower body portion; each of the two body portions has semi-circular opening. A plug base has two copper plugs and a disk-shaped member, which is fitted in an opening formed with the two semi-circular openings. The plug base and body portion can be turned at an angle of 90 degrees relatively. When the liquid type of mosquito smudge is inserted in a power outlet on a wall, the plug structure would not affected by the position of the power outlet so as to maintain the mosquito smudge always in vertical position.

In a conventional art as mentioned in U.S. Pat. No. 5,683,254, the swivel plug structure with a bulb socket, in which the bottom surface of the socket body has two symmetrical semi-circular slots; one end of each semi-circular slot has a through slot, while other end of the semi-circular slot has a stop flange. One end of the swivel base has two copper plugs, while the other end thereof has two symmetrical hook members on the disk member thereof; the hook members are to be plugged through two through slots respectively in the socket body so as to have the swivel base and the socket body connected together. An outer cover has two symmetrical stop posts, of which the lower ends are set on the semi-circular slot nearing the through slots respectively; the stop post is used for stopping of, and limiting the turning angle of the hook member.

SUMMARY OF THE INVENTION

The prime object of the present invention is to provide a rotary-plug wall lamp, in which the center of the socket body has a seat hole for receiving a rotary disk to be turned at a limited angle; the power copper pins mounted on the rotary disk are in contact with a contact copper piece and a ring-shaped copper piece through angle plates respectively; after the wall lamp is plugged in a power receptacle on wall, the socket body thereof can be turned freely within an angle of 270 degrees.

Another object of the present invention is to provide a rotary-plug wall lamp, in which the center of the socket body of the wall lamp has a seat hole, of which the outer edge has symmetrical fastening flanges for holding the rotary disk in place; the center thereof and the inner wall plate in the seat hole are connected together by means of a hollow rivet so as to have the power copper pins and the contact copper pieces in the socket body maintained in close contact; when the rotary disk turns along the round surface of the seat hole, the contact points between them do not loosen or separate from each other.

Still another object of the present invention is to provide a rotary-plug wall lamp, in which the center of the socket body of the wall lamp has a seat hole, and the inner wall surface thereof has a round channel and a through rectangular hole for receiving the round contact plate of the ring-shaped copper piece, and having a flat plate extended from the stop plate of the round contact plate passed through and reached the other end of the socket body; the round contact plate and another power copper pin can be in close and flexible contact upon the rotary disk turning at a given angle.

A further object of the present invention is to provide a rotary-plug wall lamp, in which the round channel of the seat hole in the socket body is mounted with a ring-shaped copper piece, and the inner edge of the round contact plate of the ring-shaped copper piece has a stop plate to be placed across the guide channel; a positioning block furnished in the rotary disk moves along the guide channel on the wall surface of the socket body; the positioning block will be stopped by the stop plate so as to limit the same to turn within an angle of 270 degrees.

A still further object of the present invention is to provide a rotary-plug wall lamp, in which the two power copper pins of the rotary disk are in contact with a contact piece riveted in the center thereof and a ring-shaped copper piece respectively; the flat plates on the other ends of the center contact copper piece and the ring-shaped copper piece pass through the wall surface of the seat hole respectively, and extend into the positioning channels respectively so as to have the flat plates contacted with the contact points of the circuit board firmly, and to supply the circuit board with power.

Yet another object of the present invention is to provide a rotary-plug wall lamp, in which the power copper pins of the rotary disk, the contact copper pieces in the seat hole of the socket body, the circuit board and the bulb-contact copper pieces are all mounted in place by means of plug connection, and the copper pieces are in contact each other in a flexible and good conduct condition.

DETAILED DESCRIPTION OF THE PREFERRED EMBODIMENT

Figure 2:
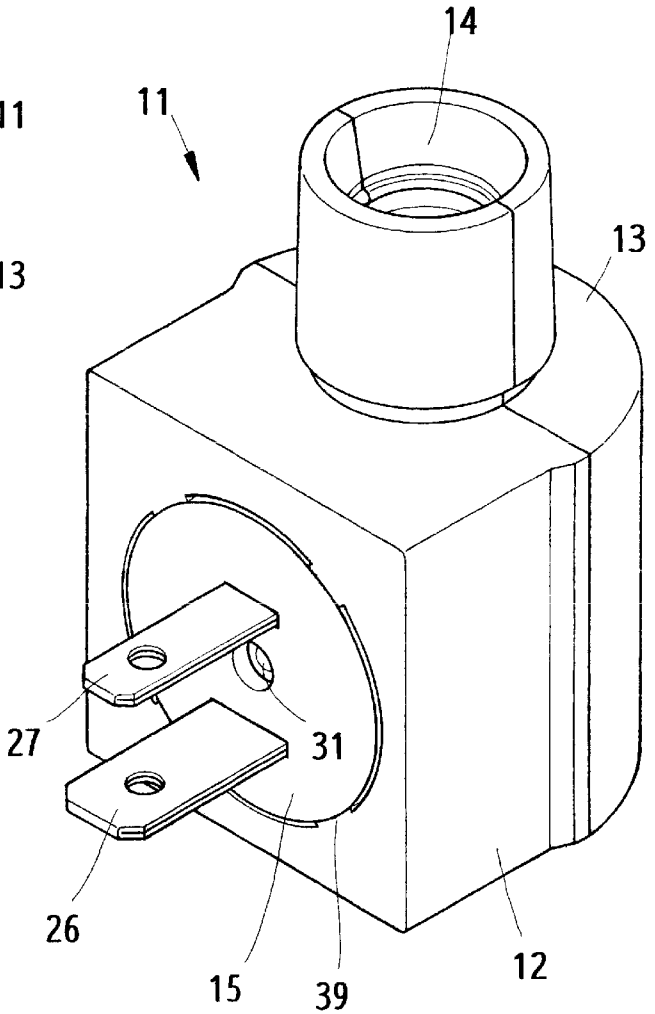
FIG. 2 is a perspective view of the present invention, showing another rotary direction of th power copper pin.
Figure 1:
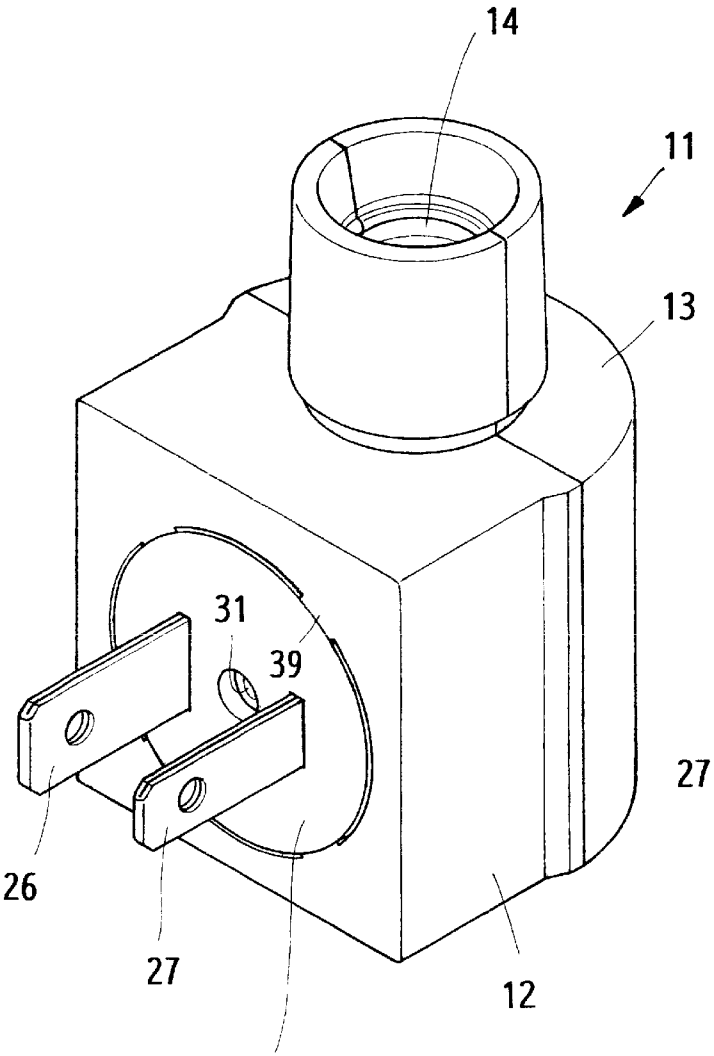
FIG. 1 is a perspective view of the present invention, showing one of the rotary direction of the power copper pin.
Figure 8:
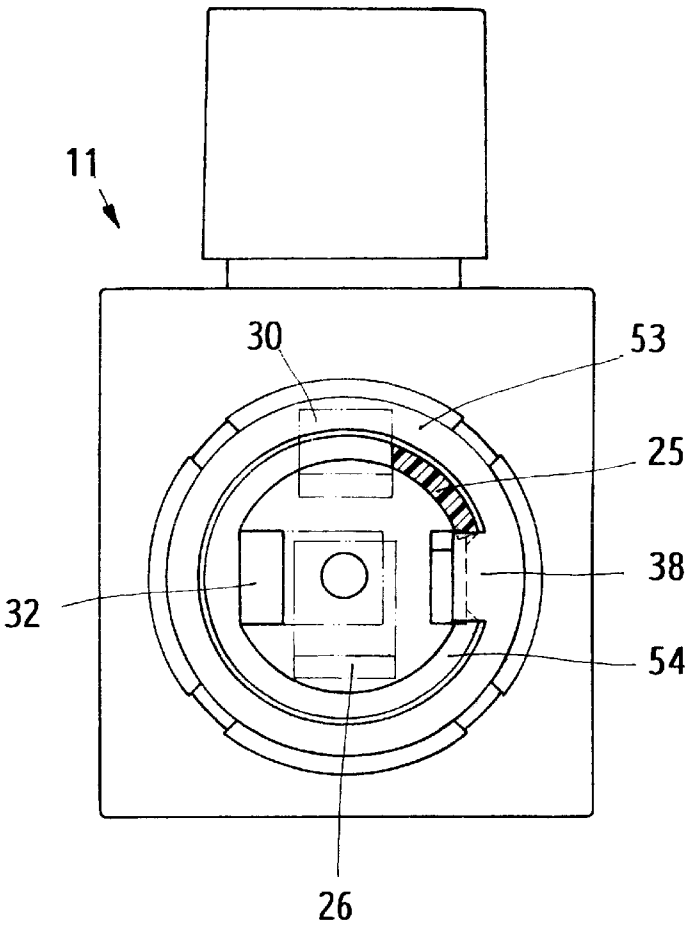
FIG. 8 is a plan view of the present invention, showing the rotary disk rotated at an angle-2.
Figure 7:
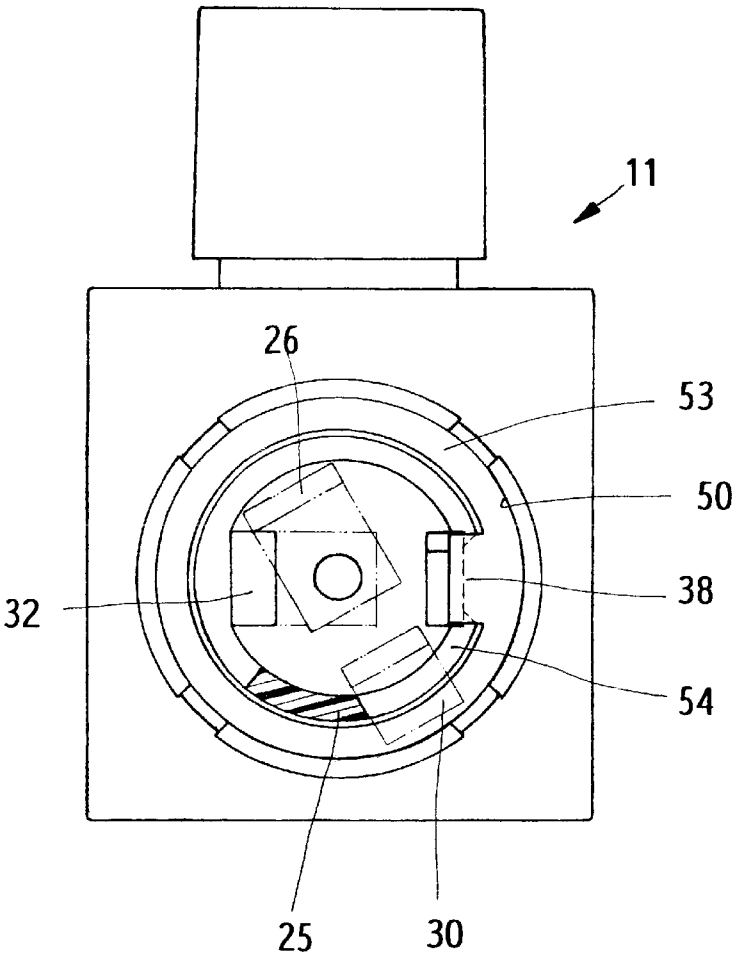
FIG. 7 is a plan view of the present invention, showing the rotary disk rotated at an angle-1.

This invention relates to a rotary-plug wall lamp; as shown in FIGS. 1, 2, 7 and 8, the wall lamp 11 comprises a socket body 12, a socket casing 13, a socket 14 and two power copper pins 26 and 27; the power copper pins 26 and 27 are mounted on a rotary disk 15 which can rotate through an angle of 270 degrees; the inner center of the rotary disk 15 has a hollow rivet 31 for holding a power copper pin 26 and a contact copper piece 32 together; another power copper pin 27 has a contact plate 30 to be in contact with a round contact plate 53 of a ring-shaped copper piece 33. When the rotary disk 15 is turned, the power copper pin 27 can maintain contact always with the round contact plate 53 so as to supply power to the wall lamp 11.

Figure 3:
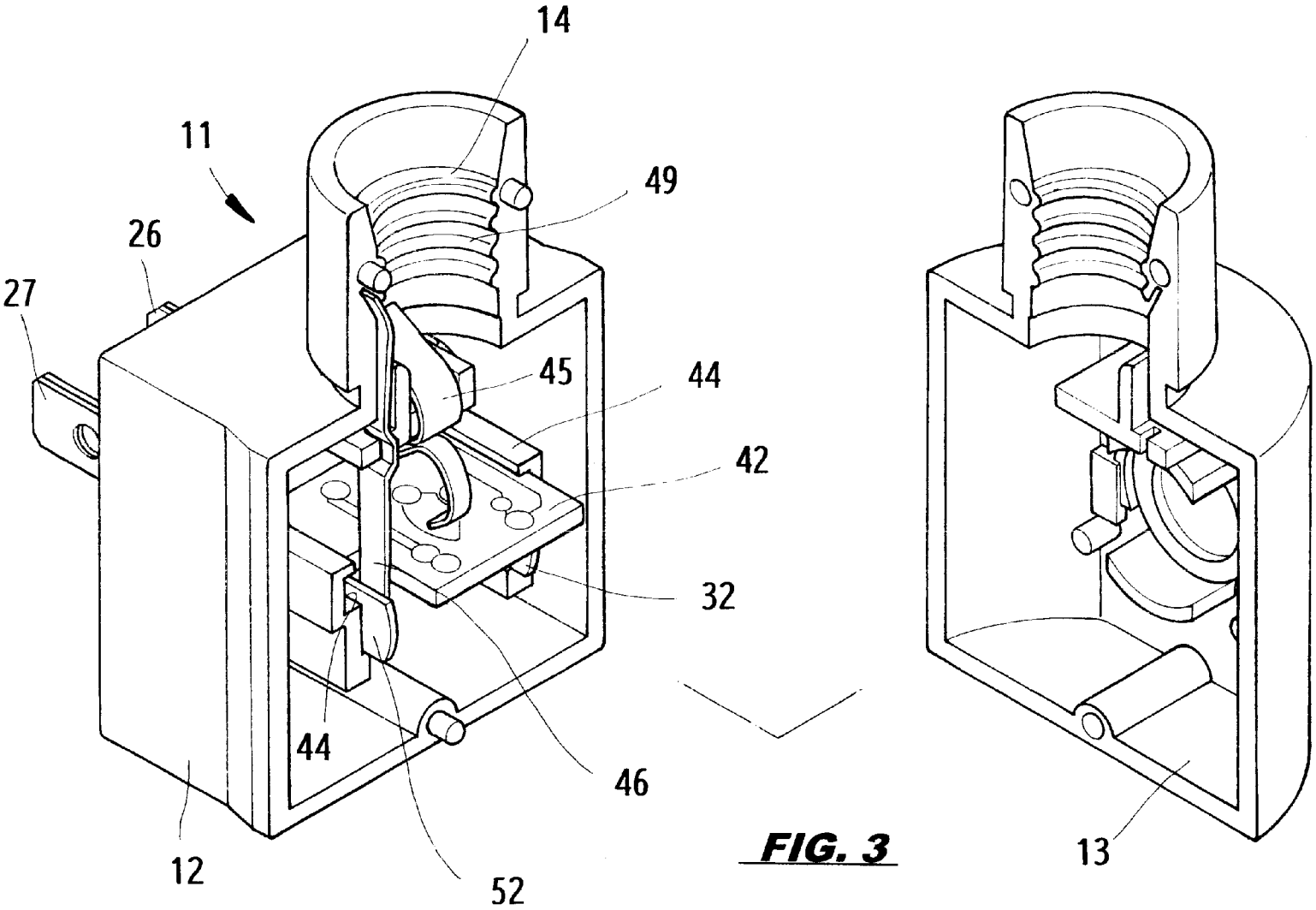
FIG. 3 is a disassembled view of the present invention, showing the disassembled relation between the socket casing and the socket body.
Figure 4:
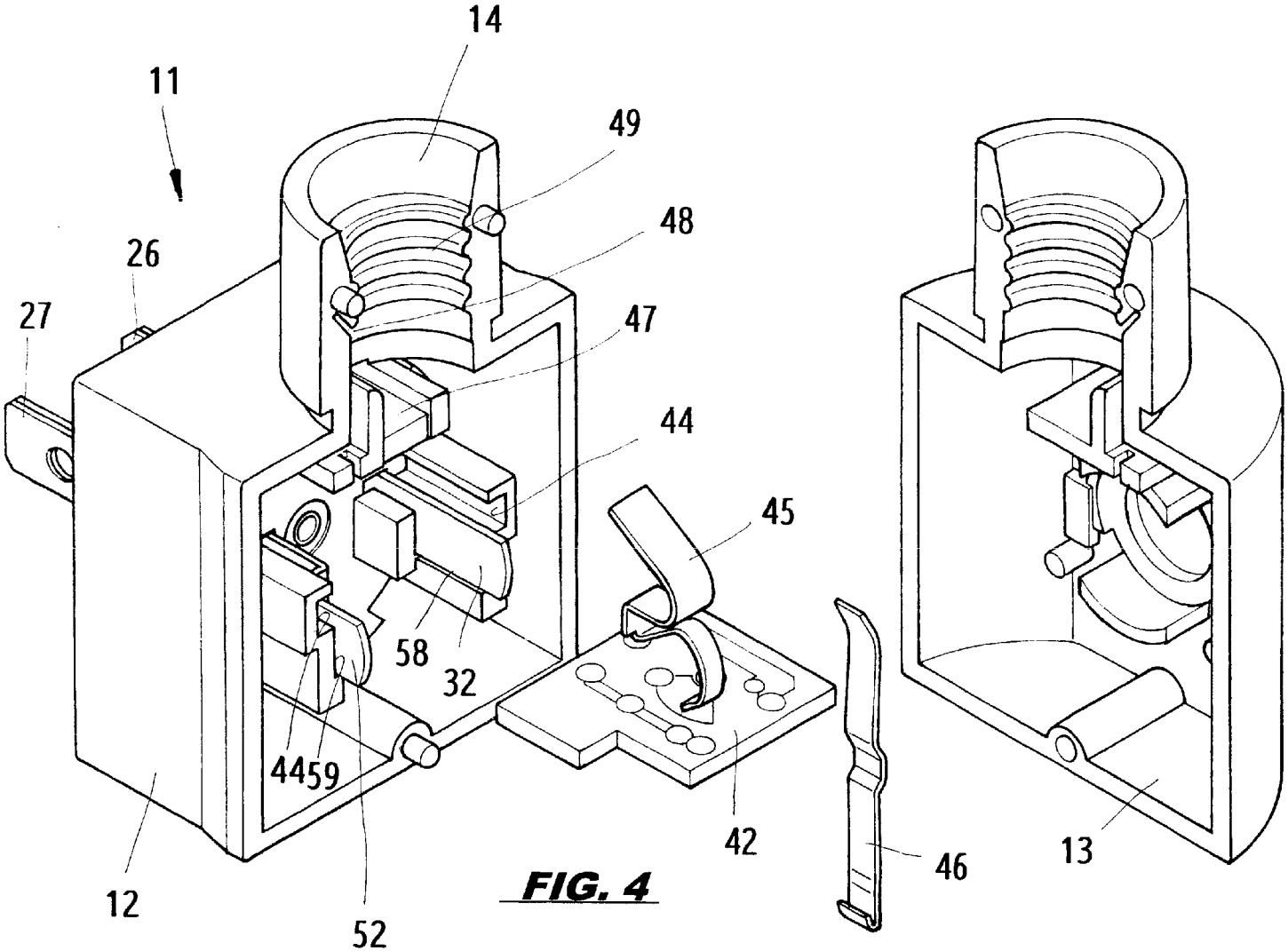
FIG. 4 is a disassembled view of the present invention, showing the disassembled relation between the circuit board and the socket body.
Figure 5:
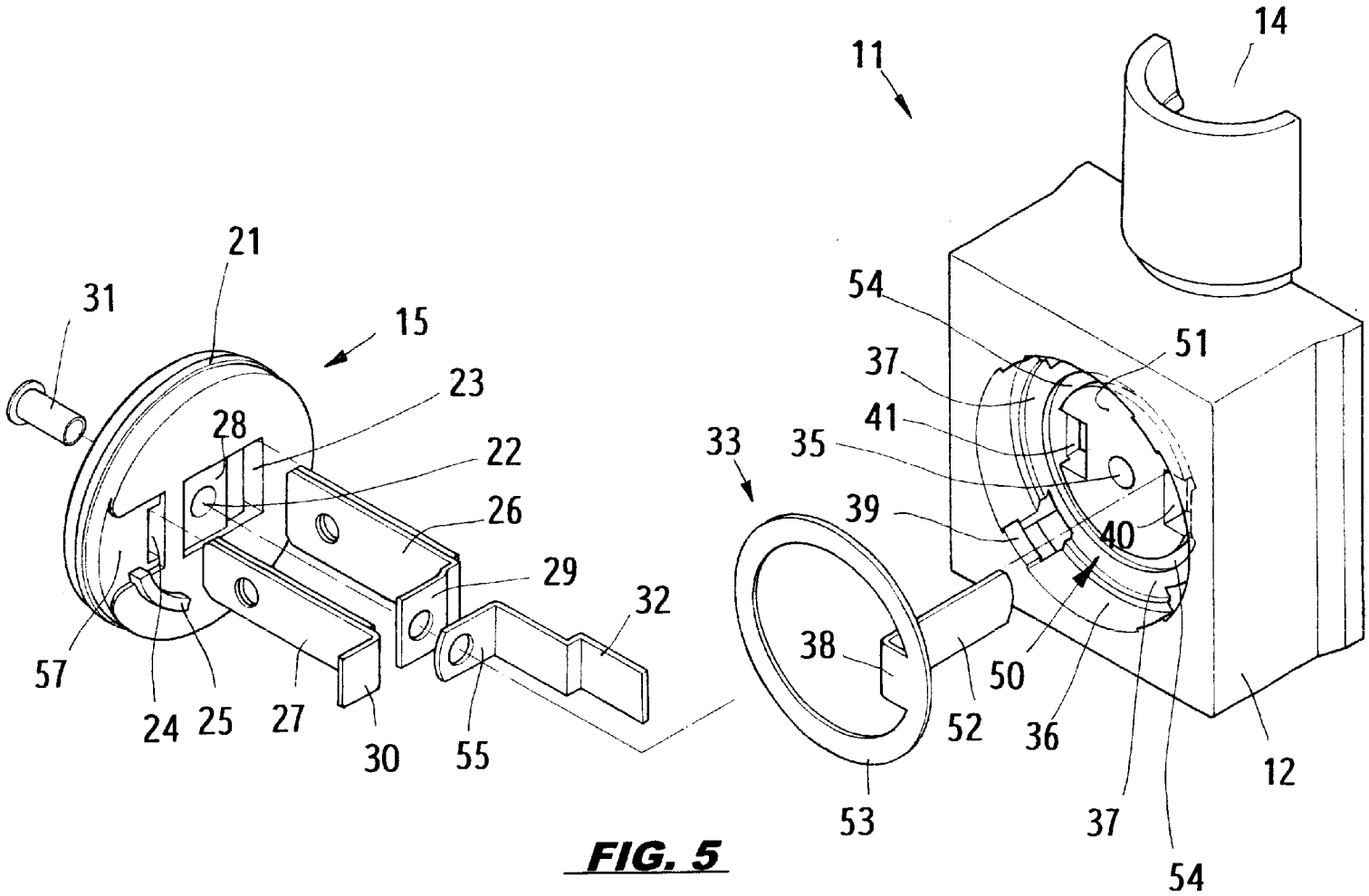
FIG. 5 is a disassembled view of the present invention, showing the disassembled relation between the rotary disk and the socket body.
Figure 6:
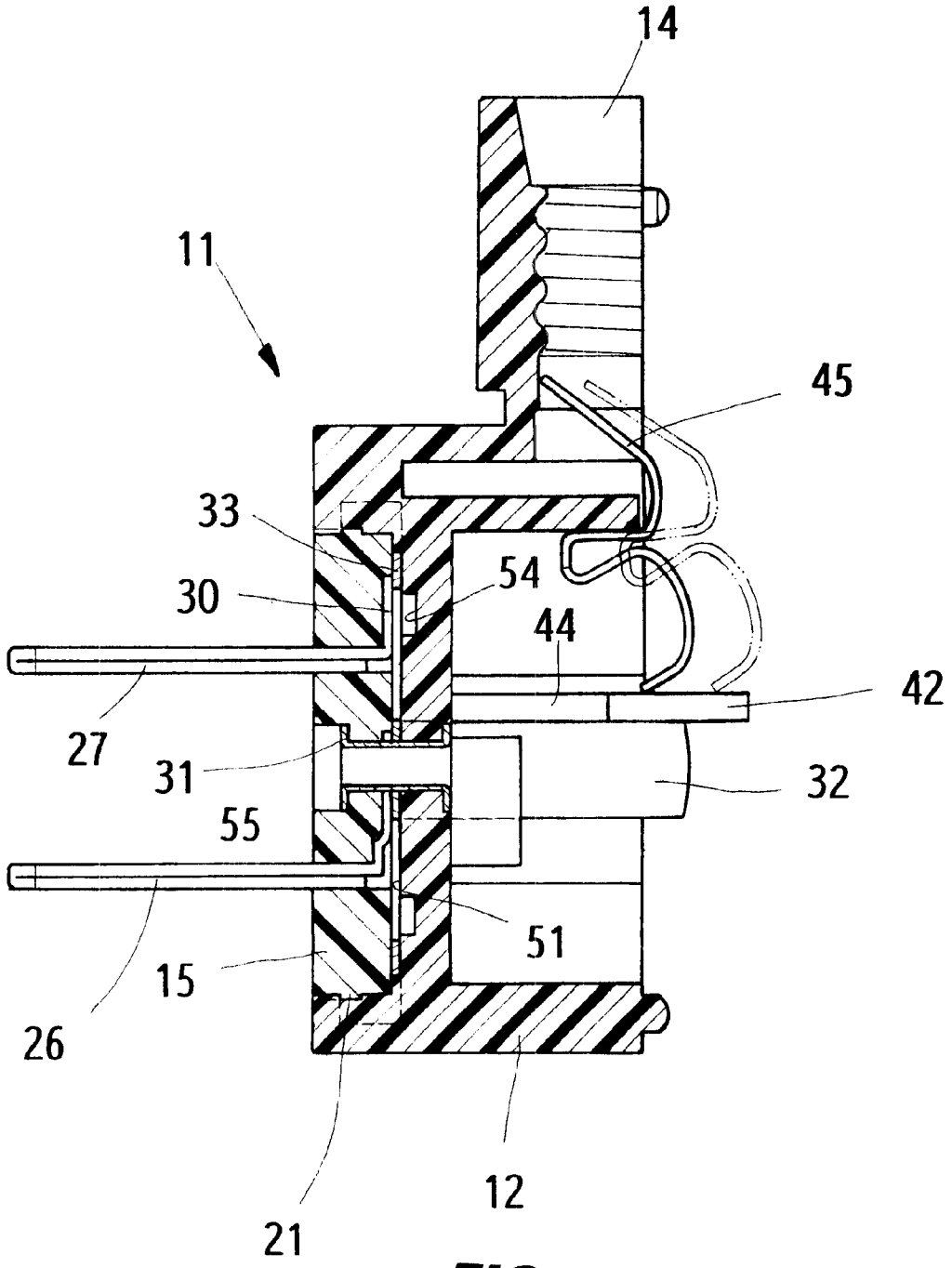
FIG. 6 is a sectional view of the present invention, showing the inner structure of the socket body.

As shown in FIGS. 3 to 6, the body portion of the wall lamp 11 includes a socket body 12, a socket casing 13 and a rotary disk 15; the outer end of the socket body 12 has a seat hole 50, of which the wall surface 51 has a round hole 35; on both sides of the round hole 35 are two rectangular holes 40 and 41 respectively; a guide channel 54 and a round channel 37 extend around the two rectangular holes 40 and 41. The opening of the seat hole 50 has a fastening flange 39; a round surface 36 under the fastening flange 39 is for guiding movement of the rotary disk 15. The inside of the socket body 12 has a plug slot 44 for receiving a circuit board 42. The upper part thereof has copper piece seats 47 and 48 for plugging the bulb-contact copper pieces 45 and 46 respectively, and threads 49 for holding a bulb. The socket casing 13 is designed to fit the assembling structure of the socket body 12.

The rotary disk 15 is substantially a round board with a ring-shaped flange 21, which is designed to fit the round surface 36 of the seat hole 50 of the socket body 12; during assembling, the rotary disk 15 should be pressed so as to have the ring-shaped flange 21 passed through the fastening flange 39, and contacted closely with the round surface 36; i.e., the rotary disk 15 is limited to turn along the round surface 36 only. The outer surface of the rotary disk 15 is on the same level with the socket body. The center of the disk 15 has a round hole 22 and a rectangular hole 23 for receiving the power copper pin 26 to pass through; the power copper pin 26 has an angle plate 29 to be put in a recess 28 under the round hole 22; the angle plate 29 has a round hole to be aligned with the through round hole of the rotary disk 15 for receiving a hollow rivet 31, which is used for assembling the rotary disk 15, the power copper pin 26, the contact copper piece 32 and the wall surface 51 of the socket body 12 together as one unit. The power pin 26 and the contact copper piece 32 are connected together to fasten on the socket body 12 by means of a rivet 31 so as to have the power copper piece extended into the socket body 12.

The inner side of the rotary disk 15 has a through rectangular hole 24 and a recess surface 57; one side of the recess surface 57 has a curved positioning block 25. The rectangular hole 24 receives power copper pin 27; the contact plate 30 of the power copper pin 27 is attached flatly on the recess surface 57. After the rotary disk 15 is mounted in the seat hole 50 of the socket body 12, the contact plate 30 will be in contact with the round contact plate 53 of the ring-shaped copper piece 33; the power copper pin can extend into the socket body 12 via the stop plate 38 and the flat plate 52.

The seat hole 50 of the socket body 12 mounts the rotary disk 15, and the wall surface 51 of seat hole 50 has a through round hole 35; on one side of the round hole is a rectangular hole 41 receiving the contact copper piece 32 to plug into a fastening channel 58. The angle plate 55 of the contact copper piece 32 is attached flatly to the wall surface 51, and the center round hole of the angle plate 55 will be in alignment with the round hole 35 of the wall surface 51. When assembling, the contact copper piece 32 is mounted first in the rectangular hole 41 and the fastening channel 58; the power copper pin 26 and the rotary disk 15 have already assembled together; when the rotary disk 15 is mounted into the seat hole 50 of the socket body 12, the round hole 22 of the rotary disk 15, the round holes of the angle plate 29 and the angle plate 55 of the contact copper piece 32, and the round hole 35 of the seat hole 50 in the socket body 12 will be in alignment with one another so as to facilitate the hollow rivet 31 to pass through; after the hollow rivet 31 is riveted in place, the power copper pin 26 and the contact copper piece 32 will be fastened together to facilitate the rotary disk 15 to turn freely.

The wall surface 51 of the socket body 12 has another through rectangular hole 40, a guide channel 54 and a round channel 37; the rectangular hole 40 is used for receiving the flat plate 52 of the ring-shaped copper piece 33 to be plugged into a fastening channel 59 therein. The ring-shaped copper piece 33 includes the round contact plate 53, a stop plate 38 and a flat plate 52; the round contact plate 53 is substantially a round copper plate having a given width, and the inside thereof has a stop plate 38 to be bent into a flat plate 52, which is to be plugged into the rectangular hole 40 of the seat hole 50. The round contact plate 53 is laid in the round channel 37 on the edge of the wall surface 51; the stop plate 38 is laid horizontally over the guide channel 54. When the flat plate 52 of the ring-shaped copper piece 33 is plugged in place during assembling, the round contact plate 53 will be laid on the round channel 37, and then the stop plate 38 will be laid horizontally on the guide channel 54; the power copper pin 27 has been fastened together with the rotary disk 15; after the rotary disk 15 and the seat hole 50 of the socket body 12 are fastened together, the contact plate 30 of the power copper pin 27 will be in contact with the round contact plate 53 of the ring-shaped copper piece 33. After the hollow rivet 31 rivets the rotary disk 15 and the socket body 12 together, the contact plate 30 of the power copper pin 27 will maintain a given flexibility so as to have the round contact plate 53 of the ring-shaped copper pin 33 contacted closely with the contact plate 30 of the power copper pin 27; even if the rotary disk 15 is turned, the contact plate 30 and the round contact plate 53 will be maintained in close contact always.

A curved positioning block 25 on the inner surface of the rotary disk 15 will be placed into the guide channel 54 of the wall surface 51 in the seat hole 50 upon the rotary disk 15 and the seat hole 50 of the socket body 12 being fastened together. The positioning block 25 has a given length horizontally. When the stop plate 38 of the ring-shaped copper piece 33 is placed on the guide channel 54 horizontally, it will take a portion of the guide channel 54; when the rotary disk 15 is turned, the rotary disk 15 will be limited at a given angle as a result of the positioning block 25 hitting the stop plate 38 of the ring-shaped copper piece 33; in that case, the rotary disk 15 can turn freely only within an angle of 270 degrees.

The seat hole 50 of the socket body 12 is used for mounting the rotary disk 15; the two power copper pins 26 and 27 fastened to the rotary disk 15 each have an angle plate 29 and a contact plate 30 respectively, which are in close contact with the contact copper piece 32 and the ring-shaped copper piece 33 in the seat hole 50 of the socket body 12, and they can maintain better contact each other within the limited turning angle. The two copper pieces 32 and 33 are plugged in two fastening channels 58 and 59 respectively, above which is a plug slot 44 for mounting a circuit board 42. The circuit board 42 is in contact with the contact copper piece 32; through the contact point of the circuit board 42, the bulb-contact copper piece 45 can be in contact with the circuit board; the other end of the bulb-contact copper piece

45 is fastened to a copper piece seat 47. The ring-shaped copper piece 33 is not in contact with the contact point of the circuit board 42; one end of the bulb-contact copper piece 46 is hooked up with the tail end of the ring-shaped copper piece 33; the other end of the bulb-contact copper piece 46 is in contact with the copper seat 48. After the two bulb-contact copper pieces 45 and 46 are mounted in place, electric power can be supplied to the bulb through the power copper pin 26, and the threads 49 of the socket 14.

According to the aforesaid description on the connection structure between the socket body 12 and the rotary disk 15 in the embodiment, the wall lamp 11 can be turned freely within an angle of 270 degrees upon plugging in a power receptacle, and the contact points of the two power copper pins 26 and 27 will be in good contact condition so as to provide the bulb with power. The specification has disclosed the features and structure of the present invention completely; it is apparent that the present invention has provided a clear improvement, which is never anticipated and achieved by any person in the field, and therefore the structure of the present invention is deemed unique.

What is claimed is:

1. A rotary plug wall lamp comprising:

a) a socket body having a socket casing attached thereto, a lamp socket formed by the socket body and socket casing;

b) an outwardly facing seat hole in a wall of the socket body, the seat hole including a first center mounting hole, first and second rectangular holes located on opposite sides of the first center mounting hole, and a guide channel located in the seat hole;

c) a copper insert piece located in the seat hole and including an annular contact plate, a stop plate extending from the annular contact plate and a flat contact plate extending from the stop plate and passing through the first rectangular hole into an interior of the socket body;

d) a rotary disk rotatably located in the seat hole, the rotary disk including a second center mounting hole, third and fourth rectangular holes located on opposite sides of the second center mounting hole; a first electrical pin extending through the third rectangular hole and including a first angle plate having a hole aligned with the second center mounting hole; a second electrical pin extending through the fourth rectangular hole and including a second contact plate in contact with the annular contact plate and a positioning block engaging the guide channel;

e) a third contact plate extending through the second rectangular hole into the interior of the socket body and including a second angle plate having a hole therethrough and in contact with the first angle plate;

f) a rivet engaging the second center mounting hole, the holes in the first and second angle plates and the first center mounting hole to rotatably connect the rotary disk to the socket body;

g) a printed circuit board mounted on the socket body in electrical contact with the third contact plate; and, h) first and second bulb contacts, the first bulb contact in electrical contact with the printed circuit board and the second bulb contact in electrical contact with the flat contact plate of the copper insert piece.

* * * * *